US007975504B2

(12) United States Patent
Whewell, Jr.

(10) Patent No.: US 7,975,504 B2
(45) Date of Patent: Jul. 12, 2011

(54) TEMPERATURE REGULATION APPARATUS AND METHOD

(76) Inventor: Robert E. Whewell, Jr., Charlotte, NC (US)

( * ) Notice: Subject to any disclaimer, the term of this patent is extended or adjusted under 35 U.S.C. 154(b) by 1047 days.

(21) Appl. No.: 11/686,080

(22) Filed: Mar. 14, 2007

(65) Prior Publication Data

US 2007/0151283 A1 Jul. 5, 2007

Related U.S. Application Data

(63) Continuation-in-part of application No. 11/253,348, filed on Oct. 19, 2005, now abandoned.

(51) Int. Cl.
*F25D 3/12* (2006.01)

(52) U.S. Cl. ..... 62/388; 62/530

(58) Field of Classification Search ..... 62/388, 62/384, 457.2, 371, 530; 426/126, 129
See application file for complete search history.

(56) References Cited

U.S. PATENT DOCUMENTS

| | | | | | |
|---|---|---|---|---|---|
| 1,843,038 | A | * | 1/1932 | McIlvain | 62/60 |
| 2,563,933 | A | * | 8/1951 | Hipps et al. | 383/86 |
| 2,677,245 | A | * | 5/1954 | Edmondson | 62/383 |
| 4,134,276 | A | * | 1/1979 | Lampard | 62/383 |
| 4,191,028 | A | * | 3/1980 | Audet et al. | 62/259.1 |
| 4,294,079 | A | * | 10/1981 | Benson | 62/60 |
| 4,413,464 | A | | 11/1983 | Larsson et al. | |
| 4,597,266 | A | * | 7/1986 | Entrekin | 62/46.1 |
| 5,152,155 | A | | 10/1992 | Shea et al. | |
| 5,709,068 | A | * | 1/1998 | Bylenga | 53/449 |
| 5,820,268 | A | | 10/1998 | Becker et al. | |
| 5,924,302 | A | * | 7/1999 | Derifield | 62/457.2 |
| 6,131,404 | A | | 10/2000 | Hase et al. | |
| 6,209,341 | B1 | | 4/2001 | Benedetti et al. | |
| 6,295,830 | B1 | | 10/2001 | Newman | |
| 6,447,826 | B1 | * | 9/2002 | Matthews | 426/126 |
| 6,574,983 | B2 | | 6/2003 | Smith et al. | |
| 7,013,670 | B2 | | 3/2006 | Gonzalez et al. | |
| 7,021,524 | B1 | | 4/2006 | Becker et al. | |
| 2002/0088244 | A1 | | 7/2002 | Jennings et al. | |
| 2003/0042264 | A1 | | 3/2003 | Stanwix et al. | |
| 2003/0084679 | A1 | | 5/2003 | Charlton et al. | |

* cited by examiner

*Primary Examiner* — Mohammad Ali
(74) *Attorney, Agent, or Firm* — Ashley Law Firm P.C.; Stephen S. Ashley, Jr.

(57) ABSTRACT

A temperature regulation apparatus includes a dry ice module that encloses dry ice so that the module's outside surface is not hazardous to touch. Insulation, breathable material, or a combination of insulating and breathable materials, allows dry ice sublimation at a sufficiently slow rate within the attached dry ice module to control the ambient temperature in the area to be cooled. The dry ice module can be attached in a location that maximizes the dry ice cooling properties, typically at or near the top of the area to be cooled. Since sublimated carbon dioxide is heavier than normal air, it falls to the bottom of the area to be cooled and builds up. The venting placement in the dry ice module is based upon the make up of the dry ice module and the breathable materials inside of it.

18 Claims, 7 Drawing Sheets

TEMPERATURE REGULATION APPARATUS AND METHOD

CROSS-REFERENCES TO RELATED APPLICATIONS

This application is a continuation-in-part of U.S. application Ser. No. 11/253,348, filed Oct. 19, 2005, now abandoned, which is incorporated herein by reference.

BACKGROUND OF THE INVENTION

1. Field of the Invention

The invention relates to an apparatus and method for regulating the temperature in an enclosed area. In one particular embodiment of the invention, the apparatus comprises a dry ice module that can be adapted or retrofitted to various items that need temperature regulating. The invention provides an apparatus for effectively utilizing dry ice as a temperature lowering means in any situation requiring the temperature to be controlled at a desired temperature. The dry ice module eliminates problems associated with the use of gel packs or wet ice ($H_2O$) as the cooling vehicle when trying to maintain a consistently low temperature. By arranging various layers of insulation materials, such as THINSULATE®, TYVEK®, and a polyethylene foam enclosed in a reflective foil, such as the product sold under the name PRODEX® FfmF insulation by Insulation 4 Less, separately or in conjunction with the other, and the dry ice, the user of the dry ice module can effectively regulate the temperature of any items requiring controlled cooling for extended periods of time by controlling the rate at which dry ice sublimates.

Due to the wide range of temperature regulation that can be achieved using dry ice, one has greater flexibility over extended periods of time when using dry ice as a means of a cooling vehicle from above freezing (greater than 32° F.), down to sub-zero temperatures, and other temperatures in between. One embodiment of the invention includes an anti-freeze bag made out of breathable material, such as a spun bonded olefin, spun bonded-melt blown-spun bonded (SMS) polyethylene, or other materials with similar properties and characteristics available today or in the future, can assist in regulating the temperature. For example, different liquids freeze at varying temperatures and when kept in a cooling compartment that is just below 32° F., water tends to freeze first. As such, water bottles can be encapsulated in an anti-freeze bag allowing them to remain liquid, while other drinks that do not freeze at temperatures just below 32° F. remain in the liquid state as well.

Preferred embodiments of the invention include a vented module that houses dry ice while encapsulated in insulating and breathable materials, or a combination of such materials, allowing for the regulation of temperature to be regulated within a particular temperature range targeted for maintaining the particular items in a cooled but unfrozen state, while also allowing individuals to safely touch the dry ice module without getting injured.

Dry ice is made of carbon dioxide gas ($CO_2$), the sublimation of which is a cooling vehicle in the present invention. Further, because of its molecular make-up $CO_2$ is heavier than atmospheric air, and therefore falls to the lowest point possible. Accordingly, a dry ice module of the present invention is preferably positioned proximate the top of an enclosed body so that the $CO_2$ gas falls downward. When the insulating and breathable materials comprising the dry ice module are assembled in a manner to achieve a desirable temperature, and the module is contained within an enclosed closed body, such as a cooler, the build up of pressure from the $CO_2$ gas accumulated within the enclosed body is typically minimal, even when the lid is not opened for an extended period of time.

2. Description of the Related Art

Portable devices have been used for cooling food, beverages, medications and other items. In addition, portable coolers have been used in commercial applications, such as the shipment of perishable cargo, the transport of temperature sensitive medicines, laboratory samples, and transport of donor organs to medical facilities. Such coolers are typically non-electric, and configured to use water ($H_2O$) in a frozen solid state ("wet ice"). However, to ensure adequate temperature regulations, one must repeatedly drain a large majority of the surplus water created from the melted wet ice, and add a fresh supply of wet ice. This process is time consuming, messy, does not provide a uniform temperature over an extended period of time, has the potential to soak and ruin inadequately protected items that are adversely affected by water, and requires a renewable source of wet ice. Although wet ice is widely available in gas stations, motels, convenience stores, restaurants, and similar commercial establishments, when temperatures surrounding the temperature sensitive materials are significantly elevated, additional supplies of wet ice may be needed more than once a day to maintain the temperature below a desired level for optimal consumption and/or spoilage prevention.

Alternatively, gel packs and other refreezable pre-packaged products are available for use instead of wet ice, or in combination therewith. However, to be reused, they have the disadvantage of requiring refreezing in something such as a household freezer, which is not typically available during travel away from home, and other environments in which the cooler is to be used. In addition, the amount of cooling time provided depends upon their size, and they are rigid which takes up valuable space that otherwise could be devoted to items requiring cooling. Further, although the gel packs and other refreezable pre-packaged products are commonly available and eliminate the messiness associated with wet ice, they are not typically large enough to provide temperature regulation for periods longer than are possible with wet ice. It would therefore be useful to have a method of temperature regulation that can maintain lowered temperatures for extended periods of time without replenishment, maintain a temperature range to protect things from spoilage, offer an alternative to current cooling methods used by individuals wearing protective body suits, and provide temperature regulation without the mess associated with wet ice and other liquid media, while also providing the ability to cool or freeze contents at a level far below conventional cooling means.

BRIEF SUMMARY OF THE INVENTION

Therefore it is an object of the present invention to provide a method for temperature regulation that can be adapted to a variety of applications.

Another object of the present invention is to provide an apparatus that can maintain lowered temperatures for extended periods of time without the mess associated with wet ice and other liquid media.

Another object of the present invention is to provide a temperature regulation apparatus that can be used to maintain the temperatures of temperature sensitive materials at temperatures at or just above freezing.

Another object of the present invention is to provide a temperature regulation apparatus that can maintain a narrow range of temperatures during the entire time of its use to protect temperature sensitive materials from spoilage.

Another object of the present invention is to provide a temperature regulation apparatus that is user friendly, environmentally friendly, and requires little monitoring or replenishment by the user during use.

Another object of the present invention is to provide a temperature regulation apparatus that can be made from durable materials, and can be subjected to repeated long-term use.

Another objective of the present invention is to provide a temperature regulation apparatus that is economically priced for a one time use/disposable product.

Another object of the invention is to provide a temperature regulation apparatus that can be permanently built into or easily retrofitted to existing coolers.

These and other objects of the invention are achieved in the preferred embodiments of the invention disclosed below. One of the preferred embodiments of the invention includes at least one dry ice module containing a quantity of dry ice, with vents incorporated into the dry ice module and venting means between the dry ice module and the space in which items needing temperature regulation are stored. The dry ice module can be a combination of different layers assembled to achieve a desired and regulated temperature for prolonged periods of time for any situation requiring dependable cooling capabilities without the continuous replenishment of a cooling vehicle, such as wet ice.

Multiple dry ice modules can be utilized with multiple cooling compartments, and each can be maintained at independent temperatures, if needed. With the proper combination of rigid or flexible insulation and single or multiple layers of polyethylene foam enclosed in a reflective foil, THINSULATE® and TYVEK®, the sublimation of dry ice is slow and the temperature is maintained in a narrow range. The outside surface of the dry ice module, used in the present invention is safe for a user to touch. Any form of dry ice can be used with the present invention, including, but not limited to, block, pellets, cryo and/or any new form of dry ice that may be developed in the future.

BRIEF DESCRIPTION OF THE DRAWINGS

Some of the objects of the invention have been set forth above. Other objects and advantages of the invention will appear as the description proceeds when taken in conjunction with the following drawings, in which.

DETAILED DESCRIPTION OF THE INVENTION AND BEST MODE

Figure 1A:
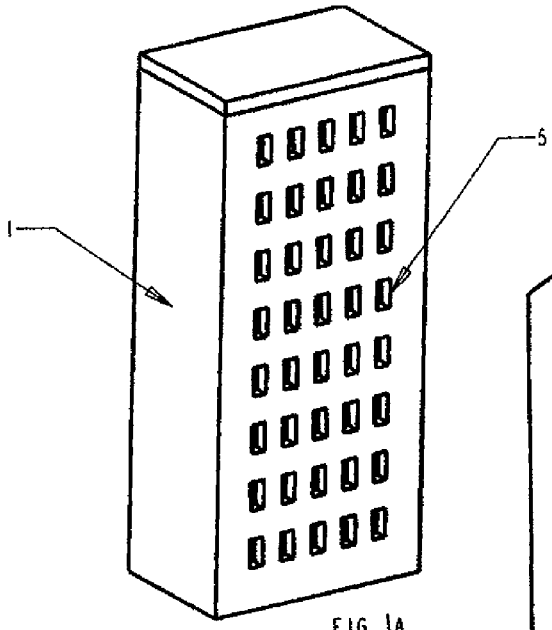
FIG. 1A is a front perspective view of a dry ice module according to a preferred embodiment of the invention.
Figure 1B:
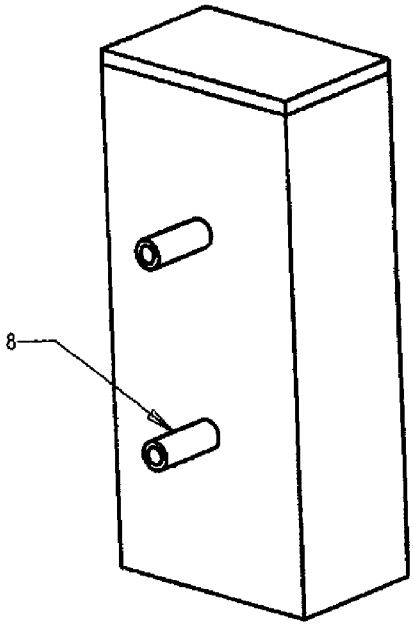
FIG. 1B is a rear view of the dry ice module of FIG. 1A.
Figure 1C:
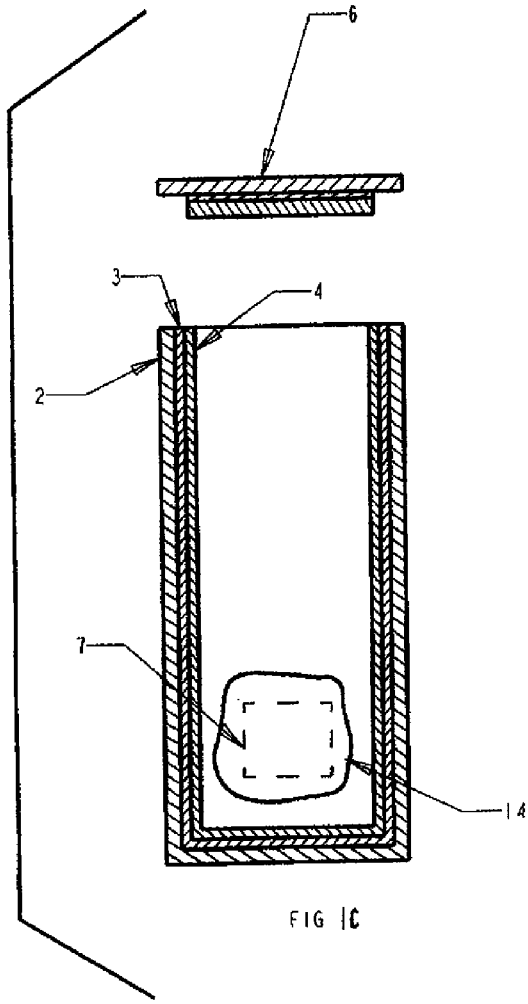
FIG. 1C is a cross-sectional view of the dry ice module of FIG. 1A.

Referring now to the drawings, wherein identical reference numerals denote the same elements throughout the various views, a temperature regulation apparatus according to a preferred embodiment of the invention is illustrated in FIGS. 1A, 1B and 1C, and shown generally at reference numeral 1. The temperature regulation apparatus comprises a dry ice module 1, which can be made from or lined with at least one insulating material 2, 3, 4 that encloses a cooling vehicle such as dry ice 7. The insulating materials 2, 3, 4 can slow down the rate of sublimation of the dry ice 7, and prevent the exterior surface of the dry ice module 1 from becoming too cold to touch.

The insulating materials 2, 3, 4 can comprise a combination of rigid insulating board or lightweight flexible insulating material, but is not limited thereto. The dry ice module 1 can made from a single insulating material 2 or a combination of materials, such as the outer layer 2, middle layer 3, and inner layer 4 shown in FIG. 1C.

In a preferred embodiment, the outer layer of insulating material 2 comprises a non-breathable material such as a polyethylene foam enclosed in a reflective foil sold under the name PRODEX® FfmF insulation by Insulation 4 Less. The middle layer of insulating material 3 comprises a breathable thermal insulating material such as a blend of superfine olefin and polyester fibers sold under the name THINSULATE® by 3M. The inner layer of insulating material 4 comprises a breathable thermal insulating material, such as a spun bonded olefin sold under the name TYVEK® by DuPont.

The dry ice module 1 can include a lid or flap 6 that can be opened for introduction of a new supply of dry ice 7 when the previously used supply of dry ice 7 is spent. The dry ice module 1 can be positioned external to or within a space requiring a controlled and or prolonged temperature. As shown in FIG. 1A, the outer layer 2 of the dry ice module 1 includes a plurality of vent holes 5 to allow for movement of the sublimated dry ice into the area needed to be cooled. The dry ice module includes attachment means, such as male couplings 8 shown in FIG. 1B, for attaching the dry ice module 1 to an enclosed structure, such as the cooling compartments 10, 10' shown in FIGS. 2 and 3.

Figure 2:
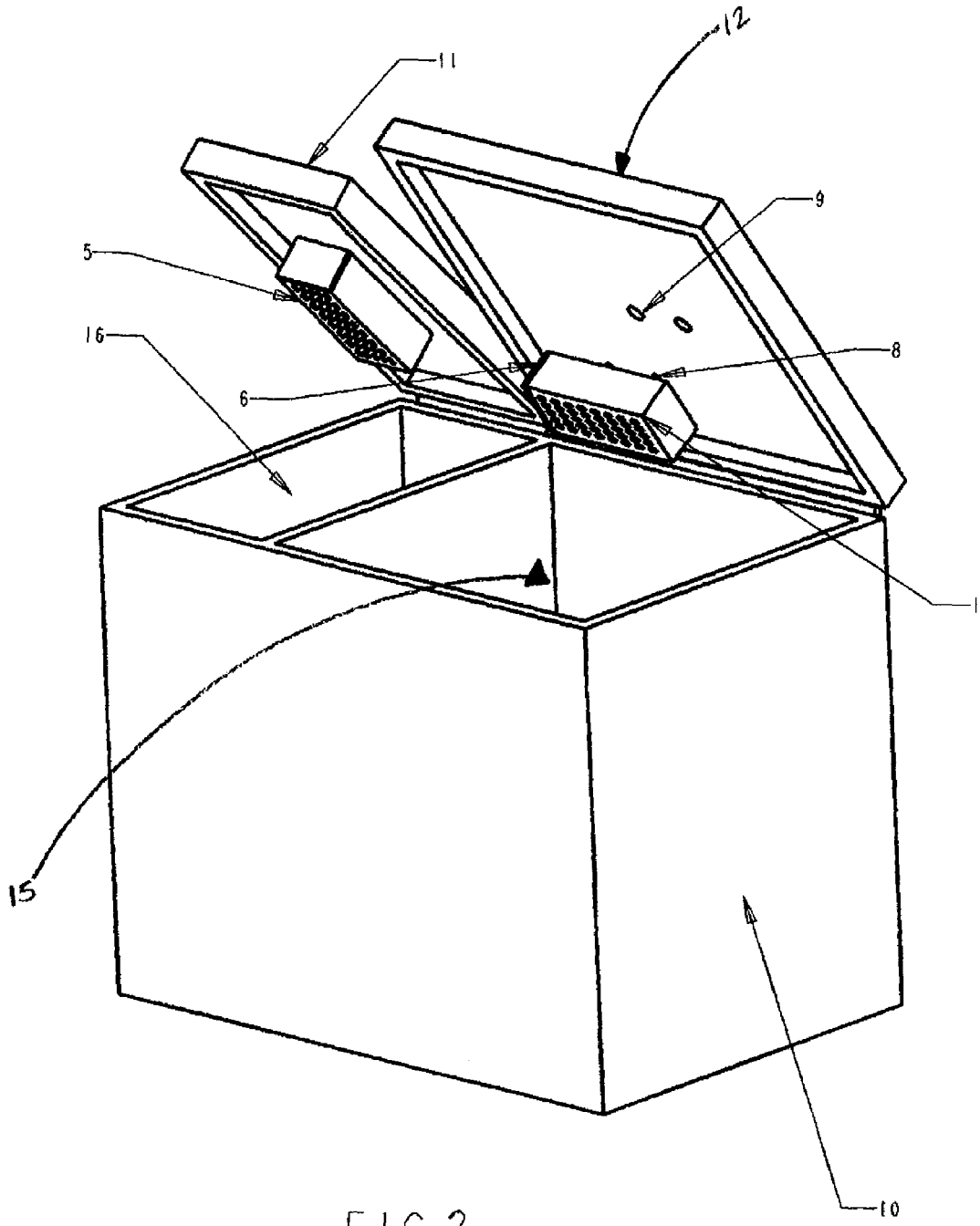
FIG. 2 is a perspective view of a cooling compartment according to a preferred embodiment of the invention.

A cooling compartment according to a preferred embodiment of the invention is illustrated in FIG. 2, and shown generally at reference numeral 10. The cooling compartment 10 includes four side walls, a bottom wall and a dividing wall defining cooling stowage areas 15, 16 for storing items to be cooled. As shown in FIG. 2, the dry ice module 1 is attached to the underside surface of a one-piece lid 11, and configured for transferring sublimated gas from dry ice module 1 into the cooling stowage area 16 below it. Likewise, a second dry ice module 1 is attached to the underside of a second lid 12 in order to supply sublimated gas into the second cooling stowage area 15. As such, the stowage areas 15, 16 can be maintained at different temperatures depending on the rate of sublimation maintained by each of the dry ice modules 1, which can be adjusted by varying the insulating materials 2, 3, 4. The dry ice modules 1 are attached to the underside of the lids 11, 12 by mating the male couplings 8 of the dry ice modules 1 with female couplings 9 in the lids 11, 12, as shown in FIG. 2. The dry ice module 1 can be removable or permanent and a part of a newly manufactured cooling compartment 10 or retrofitted to an existing cooling compartment 10 having a rigid outer surface construction or a resilient outer surface construction.

Figure 3:
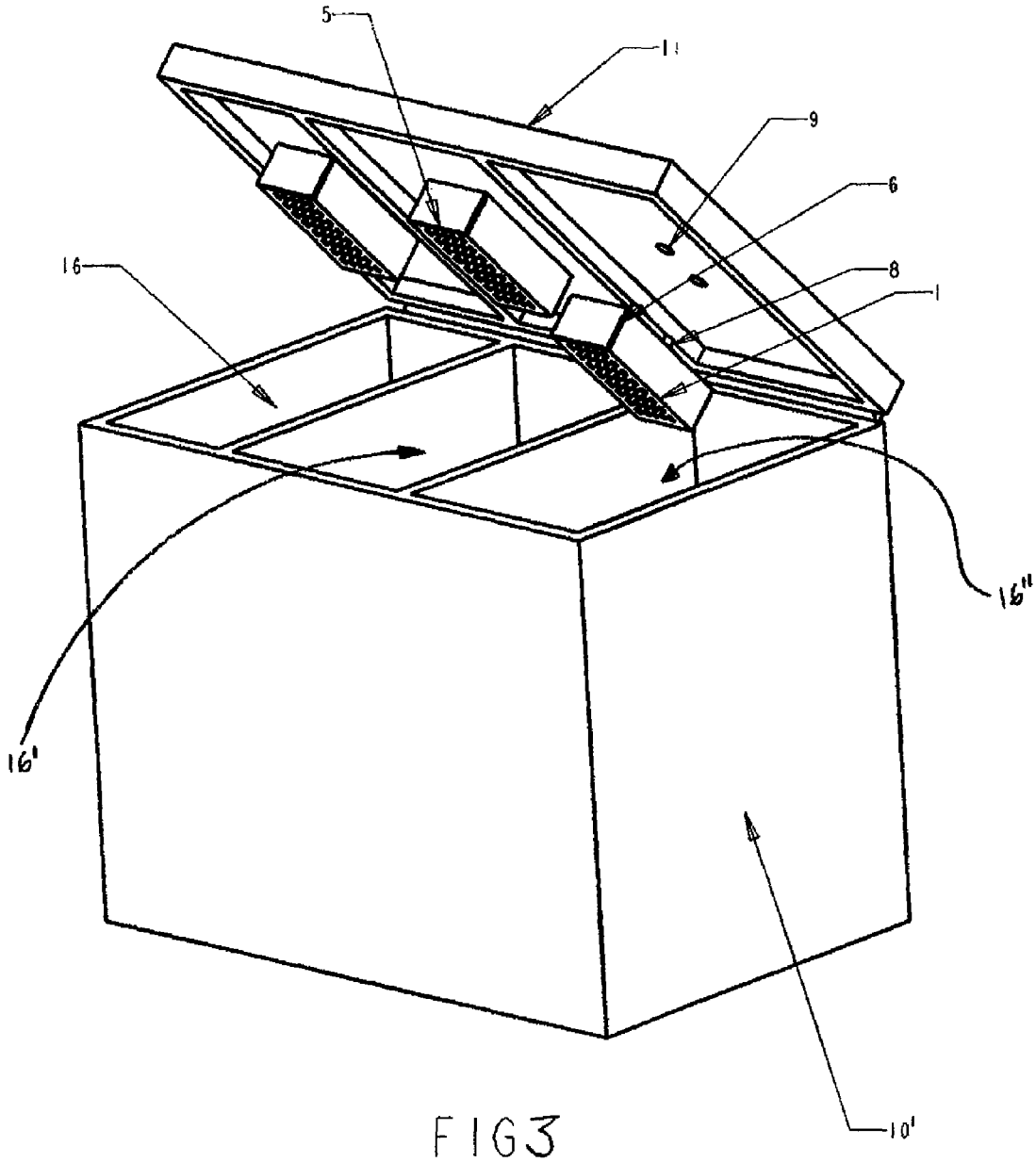
FIG. 3 is a perspective view of a cooling compartment according to another preferred embodiment of the invention.

An alternative cooling compartment 10' is shown is illustrated in FIG. 3. The cooling compartment 10' is similar to the previously described cooling compartment 10, except that it has two divider walls defining three equally sized cooling stowage areas 16, 16', 16", and just one lid 11 covering all three stowage areas 16, 16', 16".

The insulating materials 2, 3, 4 allow dry ice 7 to sublimate at a sufficiently slow rate for the regulation of the ambient temperature within an enclosed space, such as a cooling stowage area 16, requiring a controlled and prolonged temperature at a desired temperature or within a specified temperature range. The venting of sublimated $CO_2$ gas should be conducted in such a manner as to allow it to enter the area being cooled at or near the top thereof. Because $CO_2$ from sublimated dry ice is heavier than air, it will fall to the bottom. By using different wrapping and insulating materials 2, 3, 4, (or others not shown), both alone or in combination, it is possible to slow the sublimation of dry ice 7 to the point that items inside the area being cooled can exist in a temperature regulated environment that ranges from sub-zero to above freezing and can be easily changed to meet application requirements. This allows for the maximum use of dry ice 7 as a cooling medium without worrying about freezing items unless one is trying to make or keep things frozen.

In addition to controlling the sublimation process, by layering or wrapping items one can further control the temperature. For example, an "anti-freeze" bag 14, shown in FIG. 1C, made out of a spun bonded olefin, spun bonded-melt blown-spun bonded (SMS) polyethylene, or any other material with similar properties and characteristics such as breathable material 4 in FIG. 1C, can ensure that water bottles (not shown) do not freeze if the temperature inside the area being cooled is maintained just below freezing.

The dry ice module 1 is made with insulating materials 2, 3, 4 that control the sublimation rate of dry ice 7, and to prevent outer surface of dry ice module 1 from injuring human skin that comes into direct contact with it. The dry ice module 1 may be attached in such a manner that allows for the sublimation of dry ice 7 to effectively cool a specific area or items. It is contemplated for the dry ice module 1 to be removable or permanent and a part of newly manufactured item, such as a cooler or cooling device (not shown) or retrofitted to an existing item, such as a cooler or cooling device having a rigid outer surface construction or a resilient outer surface construction. In addition, although not shown in FIGS. 1A, 1B, 1C herein, any of the preferred embodiments of the present invention can have more than one area of vent holes 5 in the dry ice module 1 for movement of the sublimated dry ice into the area needed to be cooled. Different adaptation and variations can be used in the present invention for reducing the temperature, including variation in the dry ice module's 1 insulating materials 2, insulating/breathable materials 3, breathable materials 4, and other breathable materials (not shown) which directly encapsulate the dry ice 7.

Alternatively, the dry ice module 1 can comprise a soft-sided bag made from breathable material that contains dry ice 7. The dry ice module 1 is placed in an area needed to be cooled. Such a multi-layer bag may be used alone in an area needed to be cooled without any dry ice module 1 or other cooling means, due to the ever-evolving technological advances of the breathable materials, such as breathable material 4. When a multi-layer bag is used, depending upon the accuracy needed for the temperature control and what other cooling means are used, if any, the multi-layer bag used may include one or more layers of an outer insulating material, like the insulating materials 2 and 3 used to construct the dry ice module 1 shown in FIG. 1C. Therefore, for the cooling of sodas, water, and bottled fruit juices that are pasteurized and not readily prone to spoilage during an evening meal, a multi-layer bag may provide sufficient cooling without any need for maintenance or refurbishment. For daytime cooling purposes relating to pre-packaged beverages and food that does not readily spoil, a dry ice module 1 with outer insulating material 2 and single or multiple layers of breathable material 4 and/or breathable/insulating material 3 can be used. However, for medical applications relating to the transport of medications, test samples, blood supplies, and/or donor organs, a properly insulated dry ice module 1 configured with the appropriate outer insulating material 2 and single or multiple breathable/insulating material 3 and other breathable materials 4 would be required to maintain a narrow range of temperature for maximizing the usable life of stored items. The transport of poultry and other perishable meats would also benefit from the aforementioned dry ice module 1 configuration of the present invention.

As previously mentioned, in any preferred embodiment of the present invention, the dry ice 7 can be in any form and include, one or more large blocks, small chips, irregularly shaped broken pieces, small cubes, pellets, or any form that will easily fit within the targeted dry ice module 1. "Anti-freeze" bags 14 can also be used to assist in controlling the temperature of contents with a propensity toward freezing at temperatures below 320 degrees. Further, the dry ice module 1 can be permanently installed or retrofitted for existing portable or non portable units used in the regulation and the controlling of temperature wherein the dry ice module 1 is either permanently or temporarily added thereto.

When the user has items that require different temperatures, the user may employ multiple dry ice modules 1, as show in FIGS. 2 and 3, for things such as, but not limited too, drinks sandwiches or frozen treats. When the insulating and breathable materials 2, 3, 4, and/or other similar materials (not shown) that make-up dry ice module 1 are assembled in a manner to achieve a desirable temperature, the build up of pressure from the $CO_2$ gas may accumulate but is typically inconsequential, even if the storage area remains closed for extended periods of time.

It should be noted that the location of the dry ice module 1 relative to what is being cooled is not limited to one set positioning, rather placement should be determined by the place that achieves the most regulated and controlled temperature. Also, although it is contemplated for the dry ice module 1 to be secured in an elevated position to the underside surface of the cooling area's structure or in relation to the individual or individuals being cooled the positioning and orientation of dry ice module can be varied. Further, although not shown, the number and configuration of ventilation holes 5 and the male couplings 8 may be different or even absent from that shown in FIGS. 1A and 1B. Also in the alternative, the dry ice module lid 6 may be detachable, hinged, snap-fit, threaded, or have other attachment means to dry ice module 1. One factor in the selection of the size, number, and configuration of venting holes 5 and location of dry ice module 1 is the size of the dry ice module 1 and the cooling results trying to be achieved.

The dry ice modules 1 can be attached permanently, be a non-permanent fixture, or a removable fixture, and can be attached to any area needing controlled and prolonged cooling. The dry ice modules 1 can be adapted for achieving temperatures below freezing, and can be made from insulating materials 2, such as two layers of reflective foil surrounding a closed cell polyethylene foam center sold under the name PRODEX® FfmF insulation by Insulation 4 Less. The thickness of the polyethylene foam center is dependent on the results that are trying to be achieved.

The dry ice modules can be made from a combination of rigid and non-rigid insulating materials 2, be made at least in part from breathable single or multiple layered materials 3 (THINSULATE®) or 4 Non-Woven Breathable Material 4, (spun bonded olefin, SMS, or any other material with similar properties and characteristics, at present or new products in the future), be retrofitted to an existing area to be cooled, be part of the original manufacturing of such cooling units or systems or adapted for achieving and maintaining a predetermined temperature for extended periods of time. The present invention configuration and non-liquid function makes it suited for use in motorized vehicles, including but not limited to automobiles, sport-utility vehicles, vans, boats, and airplanes, where it may be permanently or temporarily secured in a designated recess in the trunk, a rear storage area, or any other suitable space.

The rectangular configuration of the dry ice module 1 shown in FIGS. 1A, 1B, 1C is not limiting, and it is contemplated for other configurations to be used, such as bag-like modules, cylindrical modules, spherical modules and the like. Further, the outer surface construction of the dry ice module may be rigid or resilient.

Figure 4:
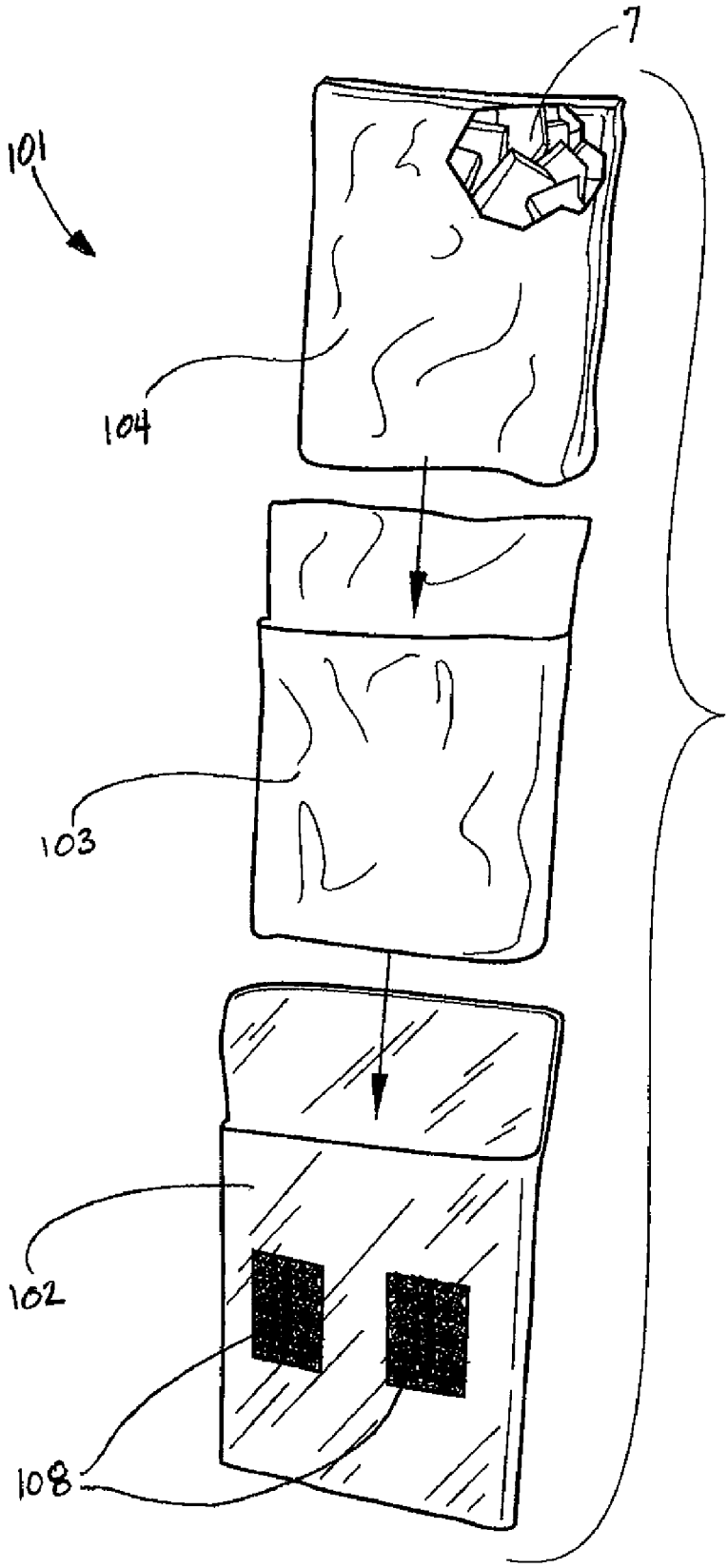
FIG. 4 is a schematic view of a dry ice module according to another preferred embodiment of the invention.
Figure 5:
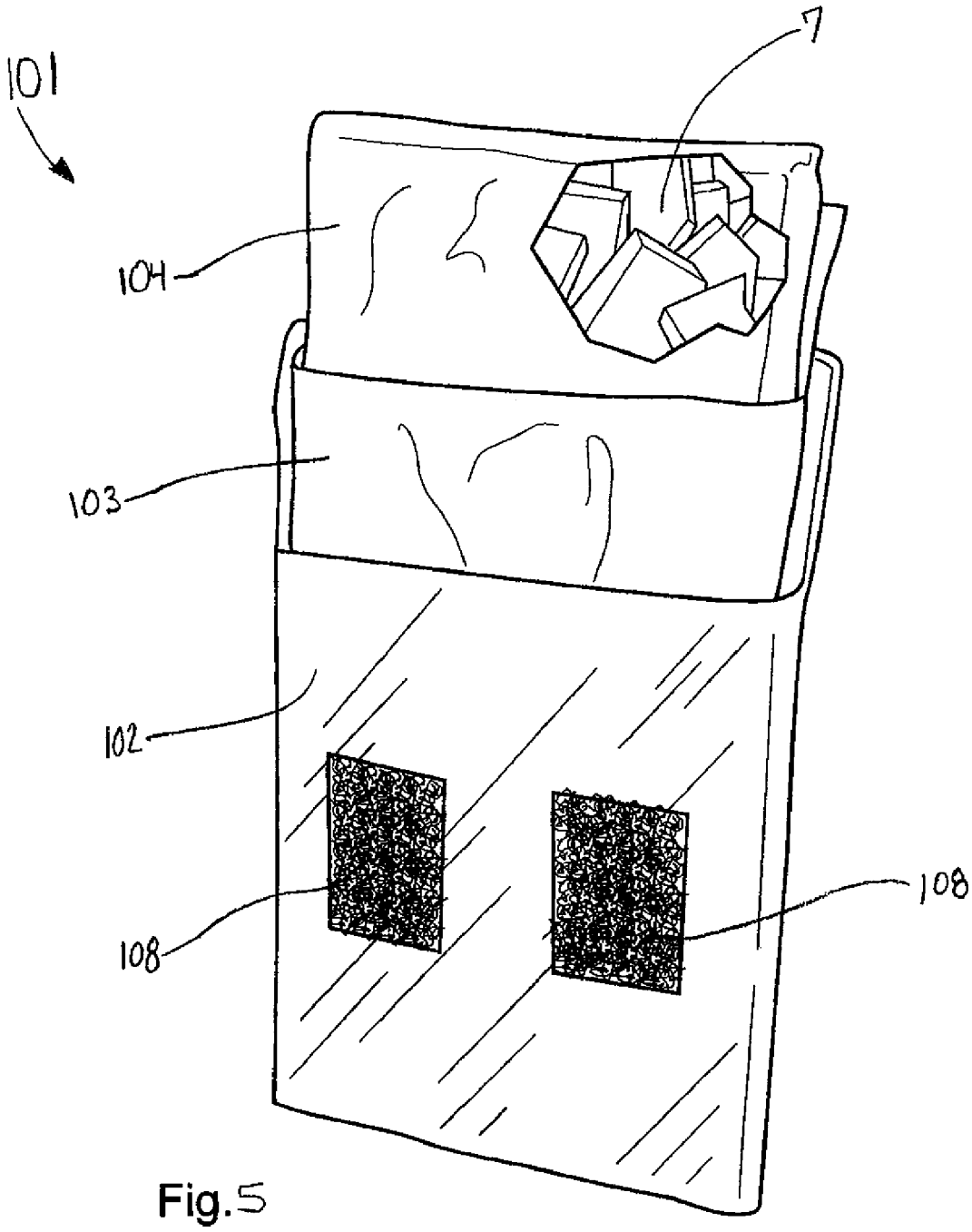
FIG. 5 is a perspective view of the dry ice module of FIG. 4.

For example, a dry ice module according to an alternative embodiment of the invention is illustrated in FIGS. 4-7, and shown generally at reference numeral 101. The dry ice module 101 comprises a multi-layered envelope, in which a cooling vehicle such as dry ice 7 is placed in an inner envelope 104 formed of breathable insulating material such as TYVEK®. As shown in FIGS. 4 and 5, the inner envelope 104 is positioned within a middle envelope 103 formed of a breathable insulating material such as THINSULATE®, and the middle envelope 103 is positioned within an outer envelope 102 formed of a non-breathable insulating material such as a polyethylene foam enclosed in reflective foil. As shown in FIG. 4, the middle envelope 104 and inner envelope 104 have flaps for closing the open ends of the envelopes 103, 104.

Figure 6:
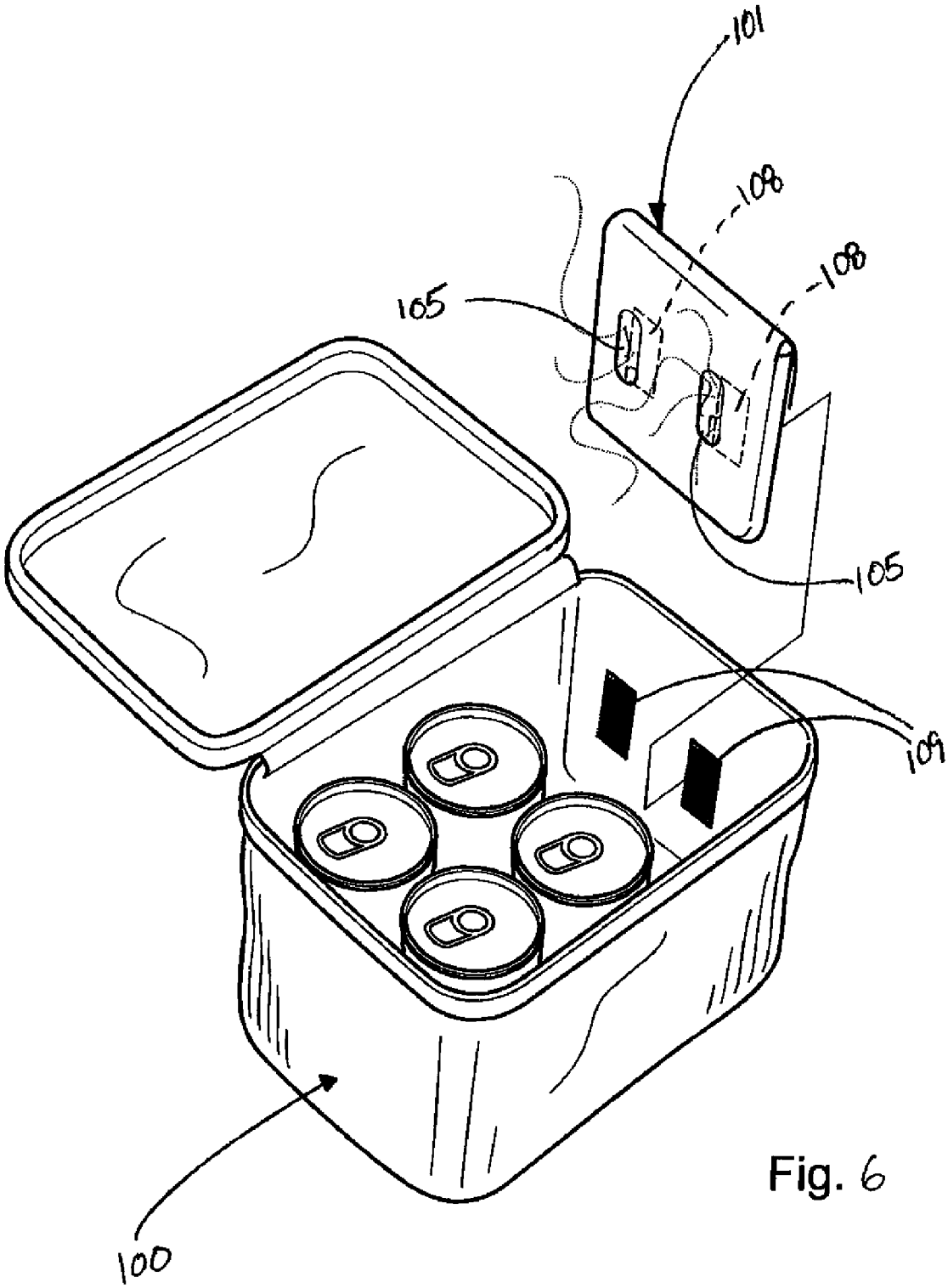
FIG. 6 is a perspective view of the dry ice module of FIG. 4 and a cooling compartment according to another preferred embodiment of the invention.
Figure 7:
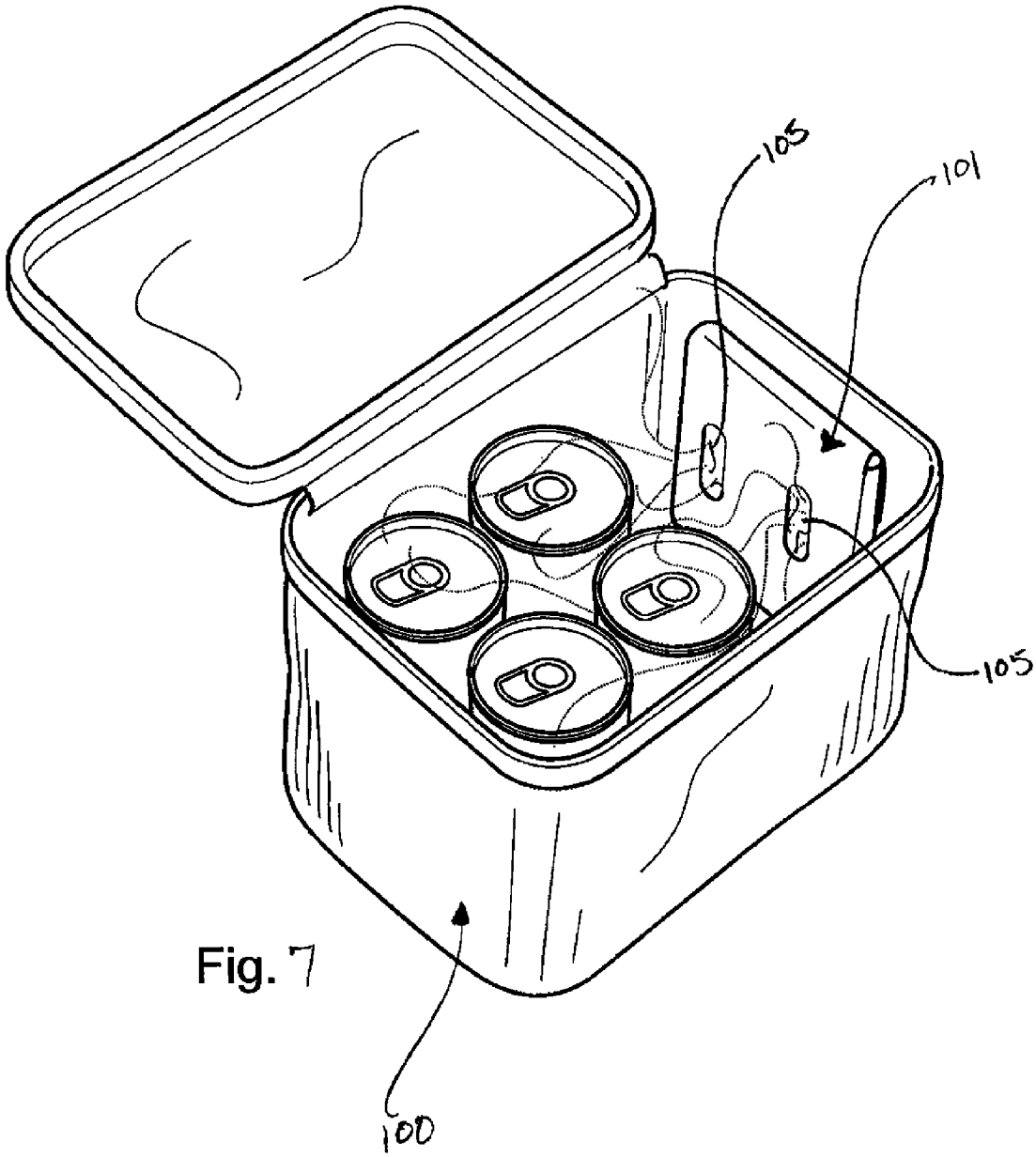
FIG. 7 is another perspective view of the dry ice module of FIG. 4 and cooling compartment of FIG. 6.

The dry ice module 101 has two hook and loop patches 108 for attaching to complementary patches 109 on an enclosed structure such as cooling compartment 100, as shown in FIGS. 6 and 7. Attachment means other than hook and loop fasteners can be used. The opposite side of the dry ice module 1' has two openings 5' for releasing sublimated $CO_2$ gas into the cooling compartment 100. If a faster rate of sublimation is desired, the middle bag 103 can be removed.

A temperature regulation apparatus and method are described above. Various details of the invention may be changed without departing from its scope. For example, variations in the size, configuration, and location of features of the invention, such as the size and material construction of any liners or dry ice module used, the type of dry ice used, and the number of dry ice modules or cooling storage areas used, can be made without departing from the scope of the invention. The foregoing description of the preferred embodiments of the invention and the best mode for practicing the invention are provided for the purpose of illustration only and not for the purpose of limitation—the invention being defined by the claims.

What is claimed is:

1. An apparatus for maintaining a controlled range of temperature for extended periods of time, comprising:

(a) an inner layer for receiving a cooling vehicle that produces a temperature cooling gas, the inner layer comprising a breathable thermal insulating material;

(b) a middle layer enclosing the inner layer comprising a breathable thermal insulating material;

(c) an outer layer enclosing the middle layer comprising a non-breathable thermal insulating material and having at least one opening for venting the cooling gas into an enclosed structure; and (d) attachment means positioned on the outer layer for attaching the apparatus to the enclosed structure.

2. An apparatus according to claim 1, wherein the cooling vehicle comprises solid carbon dioxide that produces a cooling gas upon sublimation.

3. An apparatus according to claim 1, wherein the inner layer comprises spun bonded olefin.

4. An apparatus according to claim 1, wherein the middle layer comprises a blend of olefin and polyester fibers.

5. An apparatus according to claim 1, wherein the outer layer comprises polyethylene foam enclosed in a reflective foil.

6. An apparatus according to claim 1, wherein the inner layer comprises spun bonded olefin, the middle layer comprises a blend of olefin and polyester fibers, and the outer layer comprises polyethylene foam enclosed in a reflective foil.

7. An apparatus according to claim 1, wherein the attachment means comprises at least one selected from the group consisting of a male coupling adapted for mating with a complementary female coupling attached to the enclosed structure, loop fasteners for mating with complementary hook fasteners attached to the enclosed structure, and hook fasteners for mating with complementary loop fasteners attached to the enclosed structure.

8. An apparatus according to claim 1, wherein the at least one opening comprises a plurality of circular holes.

9. An apparatus according to claim 1, wherein the inner layer, the middle layer and the outer layer form a semi-rigid rectangular module having an open end for receiving the cooling vehicle, and a removable lid for covering the open end.

10. An apparatus for maintaining a controlled range of temperature for extended periods of time, comprising:

(a) an inner envelope for receiving solid carbon dioxide comprising a breathable thermal insulating material;

(b) a flexible outer envelope enclosing the inner envelope comprising a non-breathable thermal insulating material and having at least one opening for venting of carbon dioxide gas produced during sublimation of the solid carbon dioxide; and (c) attachment means positioned on the outer envelope for attaching the apparatus to an enclosed structure; and (d) a removable middle envelope for positioning intermediate the inner envelope and the outer envelope, wherein the middle envelope encloses the inner envelope and the outer envelope encloses the middle envelope, whereby a rate of sublimation of the carbon dioxide can be increased by removing the middle envelope.

11. An apparatus according to claim 10, wherein the inner envelope comprises spun bonded olefin.

12. An apparatus according to claim 10, wherein the outer envelope comprises polyethylene foam enclosed in a reflective foil.

13. An apparatus according to claim 10, wherein the middle envelope comprises a blend of olefin and polyester fibers.

14. An apparatus according to claim 10, wherein the inner envelope comprises spun bonded olefin, the middle envelope comprises a blend of olefin and polyester fibers, and the outer envelope comprises polyethylene foam enclosed in a reflective foil.

15. An apparatus according to claim 10, wherein the middle envelope includes a first open end for receiving the inner envelope and a first flap for closing the first open end, and the outer envelope includes a second open end for receiving the middle envelope and a second flap for closing the second open end.

16. An apparatus according to claim 10, wherein the attachment means comprises at least one selected from the group consisting of loop fasteners for mating with complementary hook fasteners attached to the enclosed structure and hook fasteners for mating with complementary loop fasteners attached to the enclosed structure.

17. An apparatus for maintaining a controlled range of temperature for extended periods of time, comprising:

(a) a cooling compartment defining a storage area for storing items to be cooled; and (b) at least one dry ice module for containing a quantity of dry ice releasing cooling gas upon sublimation and comprising:

(i) an inner layer for enclosing the dry ice comprising a breathable thermal insulating material, (ii) an outer layer covering the inner layer comprising a non-breathable thermal insulating material and having at least one opening for venting the cooling gas into the cooling compartment, (iii) attachment means positioned on an outer surface of the outer layer for attaching the dry ice module to an inner surface of the cooling compartment; and (c) a removable middle layer intermediate the inner layer and the outer layer, and comprising a breathable thermal insulating material for slowing a rate of sublimation of the dry ice, wherein the rate of sublimation of the dry ice can be increased by removing the middle layer.

18. An apparatus according to claim 17, wherein the inner layer comprises spun bonded olefin, the middle layer comprises a blend of olefin and polyester fibers, and the outer layer comprises polyethylene foam enclosed in a reflective foil.

* * * * *